US009181825B2

(12) United States Patent
Batchelor, Jr.

(10) Patent No.: US 9,181,825 B2
(45) Date of Patent: Nov. 10, 2015

(54) INTERNAL COMBUSTION ENGINE INDEPENDENT VALVE ACTUATOR

(71) Applicant: Edward Hall Batchelor, Jr., Valdosta, GA (US)

(72) Inventor: Edward Hall Batchelor, Jr., Valdosta, GA (US)

( * ) Notice: Subject to any disclaimer, the term of this patent is extended or adjusted under 35 U.S.C. 154(b) by 0 days.

(21) Appl. No.: 13/868,105

(22) Filed: Apr. 23, 2013

(65) Prior Publication Data

US 2014/0311433 A1 Oct. 23, 2014

(51) Int. Cl.

| | |
|---|---|
| ***F01L 9/02*** | (2006.01) |
| ***F01L 1/46*** | (2006.01) |
| *F02D 13/02* | (2006.01) |

(52) U.S. Cl.

CPC . *F01L 9/02* (2013.01); *F01L 1/465* (2013.01); *F01L 2820/01* (2013.01); *F02D 13/0203* (2013.01)

(58) Field of Classification Search

CPC ..... F01L 9/02; F01L 1/30

USPC ..... 123/90.12, 90.24

See application file for complete search history.

(56) References Cited

U.S. PATENT DOCUMENTS

| | | | | |
|---|---|---|---|---|
| 5,833,209 | A * | 11/1998 | Steinruck | 251/47 |
| 6,321,703 | B1 * | 11/2001 | Diehl et al. | 123/90.12 |
| 2004/0194742 | A1 * | 10/2004 | Sun | 123/90.12 |

* cited by examiner

*Primary Examiner* — Zelalem Eshete

(57) ABSTRACT

A device and method for double actuating, by pressure differential, a valve of a combustion chamber of an internal combustion engine, wherein the double actuating device comprises an actuator piston displaceably arranged in an actuator cylinder between two chambers of inversely varying volume, mechanically attached to the stem of said valve. The actuating forces on said valve are selectively controllable via pressurized manifolds. The valves are double actuated independently of engine operation, the method allowing for variation in timing, duration, and lift under an electronically controlled fluid circuit, using alterable constants to allow for modifiable operating modes, also allowing reprogramming of said electronics to provide for in-place upgrades.

1 Claim, 6 Drawing Sheets

Fig. 4

Enter Test Values Below

| | | |
|---|---|---|
| *Engine RPM* | 2000 | (800-6000) |
| *Demand* | 25 | (0-100) |
| *Clamping* | 0 | (0-100) |
| *Mode:* 1) Economy | | 3 |
| 2) City | | Sport |
| 3) Sport | | |

Constants

| | |
|---|---|
| Minimum Valve Cycle Time (sec) | 0.006 |
| Desired Overlap Pulse (sec) | 0.0025 |
| Minimum Charge Pulse (sec) | 0.008 |
| Maximum RPM | 6000 |
| Valve Scale (for chart only) | 0.035 |
| Center Overlap 'Mark' (CAD) | 360 |
| Valve overlap cutout RPM | 4000 |
| Valve overlap max delay (CAD) | 60 |
| Exhaust demand factor | 0.6 |
| Intake demand factor | 0.4 |
| Valve overlap clamp factor | 0.9 |

**Calculated Values *do not modify***

Valve Constants per Mode/ RPM

| | |
|---|---|
| Exhaust Duration | 292 CAD |
| Intake Duration | 292 CAD |
| Max Lift | 12 mm |
| Revolution Time | 0.060 Seconds/ 360 CAD |
| Valve Cycle Dur. | 36 CAD |

Demand Schedule (programmable)

| | |
|---|---|
| Valve overlap demand | 0.16 |
| Exhaust | 197 CAD |
| Intake | 150 CAD |
| Min. Flow Req.s | 48 CAD |

Exhaust Details

| | |
|---|---|
| Lift Center | 271 CAD |
| Demand Flow | 197 CAD |
| Clamped Flow | 197 CAD |
| Valve Lift | 12.0 mm |

Intake Details

| | | |
|---|---|---|
| Center | 426 CAD | = 66 + 360 |
| Demand Flow | 150 CAD | |
| Clamped Flow | 150 CAD | |
| Valve Lift | 12.0 mm | |

Exhaust Profile

| | | |
|---|---|---|
| Open | | 172.5 |
| Close | 369.5 | 9.5 |
| Full Open | 190.5 CAD | |
| Start Close | 351.5 CAD | |
| Duration, Open | 161 Ref. Only | |

Intake Profile

| | | |
|---|---|---|
| Open | | 351.0 |
| Close | 501.0 | 141.0 |
| Full Open | 369.0 CAD | |
| Start Close | 483.0 CAD | |
| Duration, Open | 114 Ref. Only | |

Fig. 5a

*Sample Chamber Pressure Settings Worksheet* Pressures are gauge.

1. Input key force requirements to get associated pressures.

r (inches): 1.00

* pressure should be increased to reflect friction (5 psi suggested)

Lower chamber volume ratio [R] 2.00 :1

Variable Definitions:

*i* Upper Chamber inlet pressure -- applies opening force.

*e* Upper Chamber exhaust back-pressure -- reduces air useage and seat pressure.

*l* Lower Chamber low pressure -- applies seat pressure at full extension.

*c* Lower Chamber compressed (high) pressure -- applies return "spring" force.

| | Open (*i* -*l*) | | Close (*c*-*e*) | | Seat (*l*-*e*) | |
|---|---|---|---|---|---|---|
| | *Force* | *dPressure* | *Force* | *dPressure* | *Force* | *dPressure* |
| **Idle** | **105** | 33.4 | **105** | 33.4 | **25** | 8 |
| **Max** | **205** | 65.3 | **205** | 65.3 | **35** | 11.1 |

2. Intermediate calculations, pressure differentials

| | (C-S) |
|---|---|
| **Idle** | 25.4 |
| **Max** | 54.2 |

**3. Populate calculated pressure values into *l, c, e* and *i* columns of table below.**

| | Lower | | Upper | | |
|---|---|---|---|---|---|
| | *l ow* | *c ompressed* | *e xhaust* | *i nlet* | |
| | | | *l -S* | *O+ l* | |
| **Idle** | 10.7 | 36.1 | 2.7 | 44.1 | |
| | | | | | |
| **Max** | 39.5 | 93.7 | 28.4 | 104.8 | |
| STEP | 2.06 | 4.11 | 1.84 | 4.34 | <---- |

*These are the delta values used for the pressure schedule in the microcontroller.*

Fig. 5b

| RPM dis/ engage | | | Inputs (gauge pressure psi) Chamber Lower low | comp. | Upper exhaust | inlet | Sample Calculated Force Applied Table Valve Open (i -l) psi | lbs | Gap (i -c) psi | lbs | Close psi | lbs | Seat psi | lbs | Avg. Force Open | Close |
|---|---|---|---|---|---|---|---|---|---|---|---|---|---|---|---|---|
| | 0 | Stepped for startup | 5.0 | 24.7 | 0.0 | 30.0 | 25.0 | 78.5 | 5.3 | 16.7 | 24.7 | 77.6 | 5.0 | 15.7 | 47.6 | 46.7 |
| | 400 | | 7.0 | 28.7 | 0.5 | 34.0 | 27.0 | 84.8 | 5.3 | 16.7 | 28.2 | 88.6 | 6.5 | 20.4 | 50.7 | 54.5 |
| | 800 | | 8.0 | 30.7 | 1.0 | 37.0 | 29.0 | 91.1 | 6.3 | 19.8 | 29.7 | 93.3 | 7.0 | 22.0 | 55.4 | 57.6 |
| 700 | 1100 | | 10.7 | 36.1 | 2.7 | 44.1 | 33.4 | 104.9 | 8.0 | 25.1 | 33.4 | 104.9 | 8.0 | 25.1 | 65.0 | 65.0 |
| 1350 | 1450 | | 12.8 | 40.3 | 4.5 | 48.4 | 35.6 | 111.8 | 8.1 | 25.4 | 35.8 | 112.5 | 8.3 | 26.1 | 68.6 | 69.3 |
| 1700 | 1800 | | 14.8 | 44.3 | 6.4 | 52.8 | 38.0 | 119.4 | 8.5 | 26.7 | 37.9 | 119.1 | 8.4 | 26.4 | 73.0 | 72.7 |
| 2050 | 2150 | | 16.9 | 48.5 | 8.2 | 57.1 | 40.2 | 126.3 | 8.6 | 27.0 | 40.3 | 126.6 | 8.7 | 27.3 | 76.7 | 77.0 |
| 2400 | 2500 | | 18.9 | 52.5 | 10.1 | 61.5 | 42.6 | 133.8 | 9.0 | 28.3 | 42.4 | 133.2 | 8.8 | 27.6 | 81.1 | 80.4 |
| 2750 | 2850 | | 21.0 | 56.7 | 11.9 | 65.8 | 44.8 | 140.7 | 9.1 | 28.6 | 44.8 | 140.7 | 9.1 | 28.6 | 84.7 | 84.7 |
| 3100 | 3200 | Higher rpm ↓ | 23.1 | 60.9 | 13.7 | 70.1 | 47.0 | 147.7 | 9.2 | 28.9 | 47.2 | 148.3 | 9.4 | 29.5 | 88.3 | 88.9 |
| 3450 | 3550 | | 25.1 | 64.9 | 15.6 | 74.5 | 49.4 | 155.2 | 9.6 | 30.2 | 49.3 | 154.9 | 9.5 | 29.8 | 92.7 | 92.4 |
| 3800 | 3900 | | 27.2 | 69.1 | 17.4 | 78.8 | 51.6 | 162.1 | 9.7 | 30.5 | 51.7 | 162.4 | 9.8 | 30.8 | 96.3 | 96.6 |
| 4150 | 4250 | | 29.2 | 73.1 | 19.3 | 83.2 | 54.0 | 169.6 | 10.1 | 31.7 | 53.8 | 169.0 | 9.9 | 31.1 | 100.7 | 100.1 |
| 4500 | 4600 | | 31.3 | 77.3 | 21.1 | 87.5 | 56.2 | 176.6 | 10.2 | 32.0 | 56.2 | 176.6 | 10.2 | 32.0 | 104.3 | 104.3 |
| 4850 | 4950 | | 33.4 | 81.5 | 22.9 | 91.8 | 58.4 | 183.5 | 10.3 | 32.4 | 58.6 | 184.1 | 10.5 | 33.0 | 107.9 | 108.5 |
| 5200 | 5300 | | 35.4 | 85.5 | 24.8 | 96.2 | 60.8 | 191.0 | 10.7 | 33.6 | 60.7 | 190.7 | 10.6 | 33.3 | 112.3 | 112.0 |
| 5550 | 5650 | | 37.5 | 89.7 | 26.6 | 100.5 | 63.0 | 197.9 | 10.8 | 33.9 | 63.1 | 198.2 | 10.9 | 34.2 | 115.9 | 116.2 |
| 5900 | 6000 | | 39.5 | 93.7 | 28.5 | 104.9 | 65.4 | 205.5 | 11.2 | 35.2 | 65.2 | 204.8 | 11.0 | 34.6 | 120.3 | 119.7 |

Exhaust valve (15) pressures shown, Intake valve (15) seat pressure has to be increased to offset turbocharger pressure.

Avg. Force increases with RPM to combat valve float while creating less mechanical stress at low RPM.

INTERNAL COMBUSTION ENGINE INDEPENDENT VALVE ACTUATOR

CROSS-REFERENCE TO RELATED APPLICATIONS

Provisional application No. 61637207 filed Apr. 23, 2012.

STATEMENT REGARDING FEDERALLY SPONSORED RESEARCH OR DEVELOPMENT

Not applicable.

BACKGROUND OF THE INVENTION

Patent Citations

U.S. Pat. No. 8,056,515 B2 Nov. 15, 2011 Mats Hedman Assignee: Cargine Engineering Method and device for the operation of a valve of the combustion chamber . . . .

U.S. Pat. No. 7,984,701 Jul. 26, 2011 Re Fiorentin et al. Assignee: Fiat Auto Spa Device for controlling the movement of a valve, . . . , of an internal combustion engine.

EP1770247 A2 Sep. 28, 2005 Chiavazzo, Dell'Orto, et al. Electro-hydraulic variable valve actuator and method to control valves . . . .

20050188928 Sep. 1, 2005 Sedda, Emmanuel et al. Electromagnetic valve actuating device for an internal combustion engine.

U.S. Pat. No. 6,315,265 B1 Nov. 13, 2001 Adler et al. Variable valve timing actuator.

The present invention relates to a device and method for the actuation of a valve of a combustion chamber of an internal combustion engine, independently of mechanical movement within the engine and without a camshaft.

The majority of existing internal combustion engine designs rely on mechanical means to open and close intake and exhaust valves. Other types of actuators have been proposed for years based on the concept that variable valve actuation independent of engine operation could overcome inherent compromises and inefficiencies in cam driven (mechanical) operation. The present invention addresses these compromises in engine operations and offers increased flexibility for the engine designer and increased efficiency in operation.

Inherent inflexibility in valve train operation has usually meant that completely different parts had to be installed to change engine valve operation. Some benefits of variable valve timing and lift are seen in mechanical designs that provide variable mechanical actuation determined by load or engine speed. These have become popular but still present a very limited option (usually 2 or 3 configurations) compared to actuating the valves independent of engine operation. The present invention provides a broader selection of operating parameters approaching a continuously variable design.

Other inventions in the field include electromechanical, hydraulic and pneumatic systems, although these have usually been supplemented by mechanical return springs which retain many of the other limitations of the primarily mechanical designs. These limitations include high stresses at low rpm in order to meet high rpm needs, inherent harmonic oscillations that can cause valve 'float' under some conditions, elastic failure in which springs 'relax' over time and perform less well with age—regardless of usage. A pneumatic valve return system was adopted for Formula I racing cars which still relied on mechanical (cam) valve activation and suffered from failure modes not seen in other systems. The present invention addresses these limitations while providing unique upgrade and customization paths.

BRIEF SUMMARY OF THE INVENTION

The present invention is directed to a double acting valve actuator for controlling the movement of a valve of an internal combustion engine, the actuation device comprising: an actuator piston or diaphragm, contained within a cylinder, mechanically affixed to the valve stem so as to control the position of the valve via chamber-pressure differential using a compressible medium in the lower chamber, and a field programmable, electronically controlled fluid circuit for controlling the inlet and outlet of pressurized fluid to both chambers. The method for controlling the movement of the actuator piston by controlling the pressures and timing of the pressure changes will permit variable valve actuation: timing, duration, and lift. The method of controlling valve actuation with programmable variables will permit engine designers and tuners to tailor engine performance specifications while providing a convenient method for maintenance upgrades. These and other features, aspects, and advantages of the present invention will become better understood with reference to the following description and claims.

BRIEF DESCRIPTION OF THE SEVERAL VIEWS OF THE DRAWINGS

Further characteristic features and advantages of the invention are set out in the following detailed description, given purely by way of non-limiting example and made with reference to the accompanying drawings, in which:

FIG. 4 shows a tabular representation of one version of the table of constants stored by the electronic control circuit and a tabular representation of one version of the calculated values used to control operation of a valve actuator of the present invention.

FIGS. 5A and 5B show tabular representations of one version of the pressure settings vs. engine rpm calculations for programming regulators of a valve actuator system of the present invention based on supposed input required forces as examples of the dynamic control settings the system is designed to use.

DETAILED DESCRIPTION OF THE INVENTION

In referring to the diagrams, the following terms will be used for brevity and clarity but are not meant to limit the scope of the claims: fluid is a liquid or gas such as hydraulic fluid or air, a spool is a flow control device such as a poppet valve or pneumatic spool or hydraulic spool for communicating fluid flow and pressure, a check valve is a one-way check valve or an adjustable pressure regulating device in combination with a one-way check valve, a piston is a piston or a diaphragm, a valve is an intake or exhaust valve of a combustion chamber of an internal combustion engine.

Figure 1:
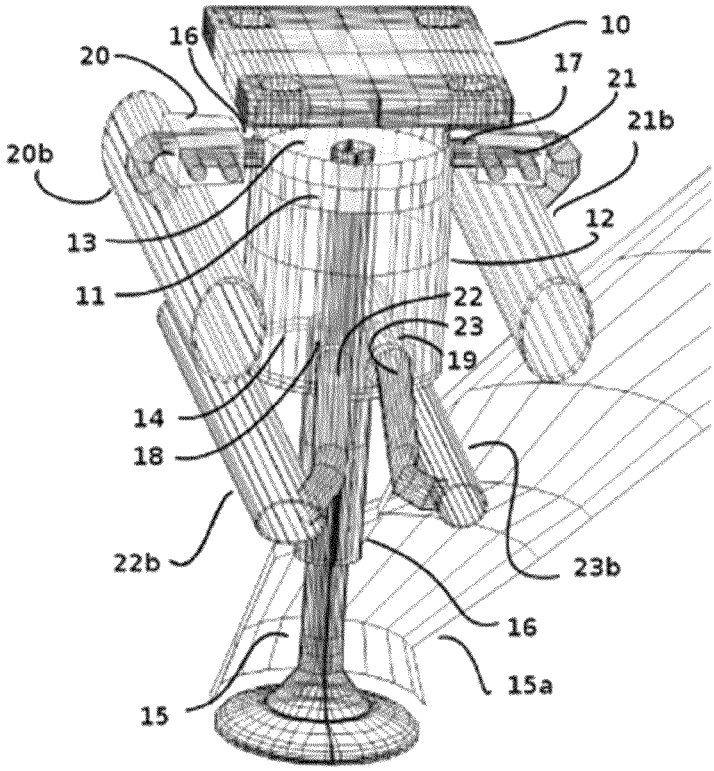
FIG. 1 shows a diagrammatic view in perspective of an internal combustion engine valve and stem associated with one embodiment of a valve actuating device of the present invention, the valve being in the closed position.
Figure 2:
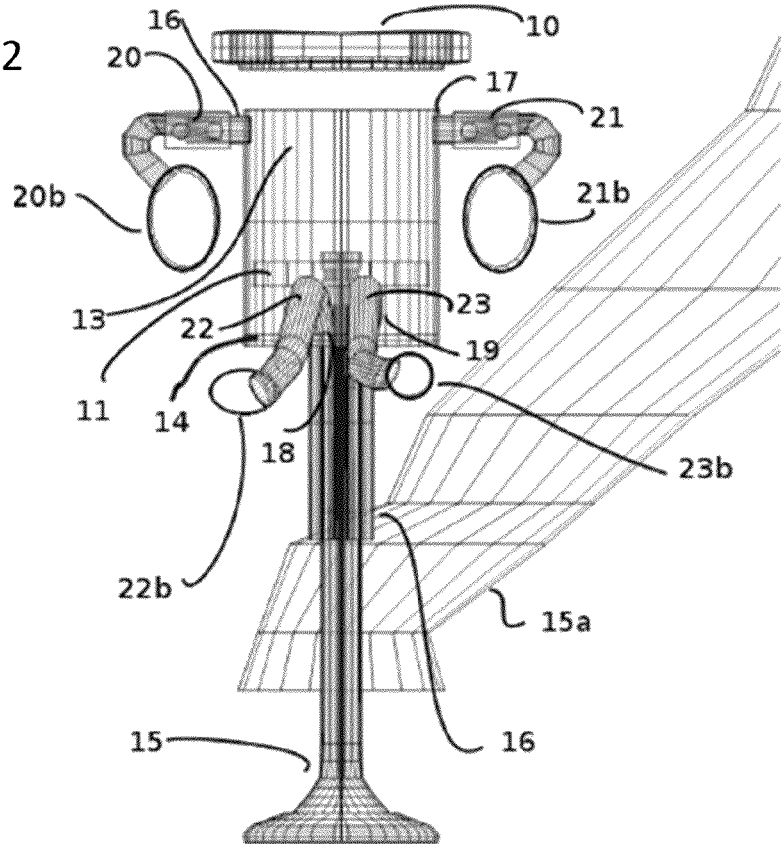
FIG. 2 shows a diagrammatic view in elevation of an internal combustion engine valve and stem associated with one embodiment of a valve actuating device of the present invention, the valve being in the open position.
Figure 6:
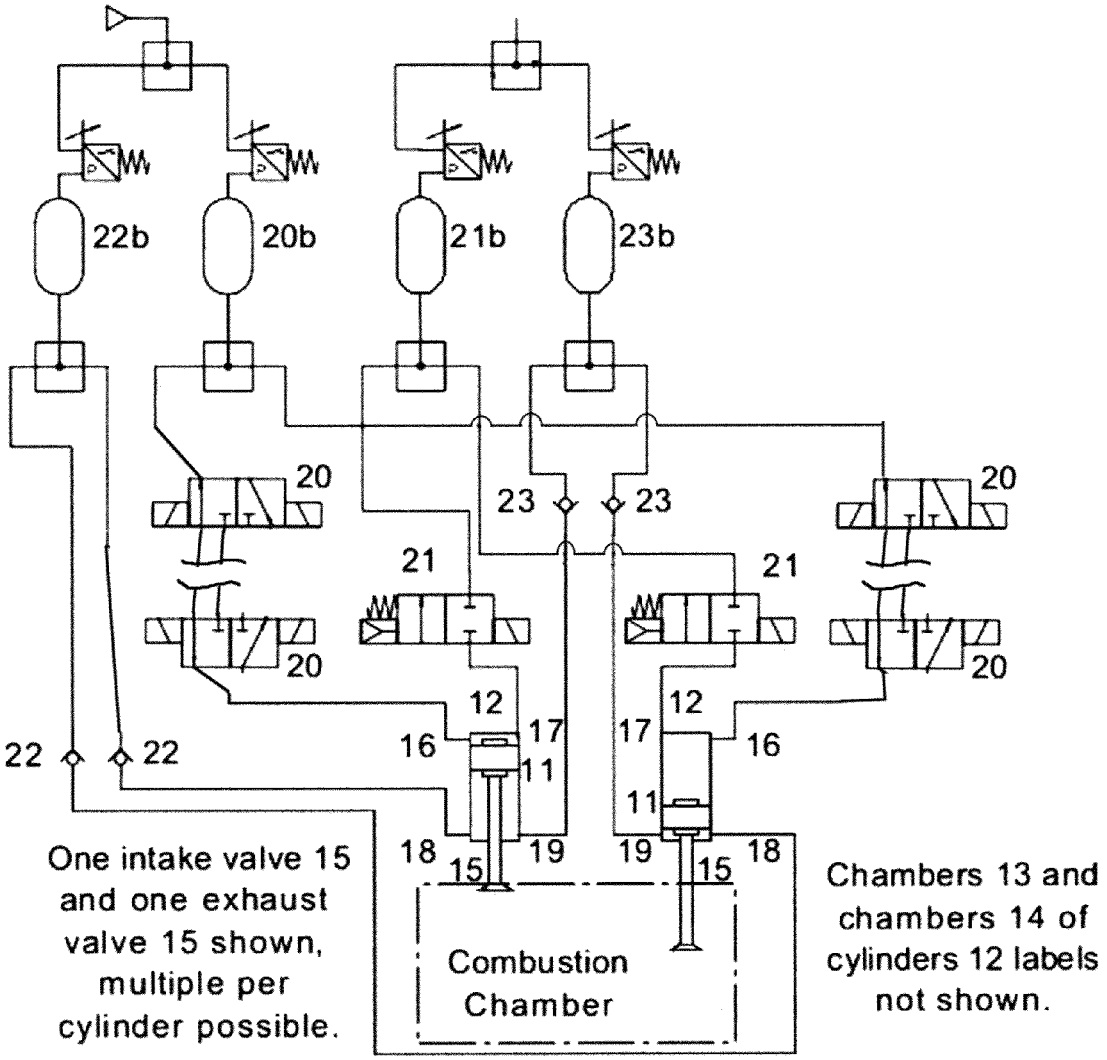
FIG. 6 shows a schematic diagram of one version of a fluid circuit for a system of valve actuators of the present invention as applied to one cylinder of an internal combustion engine of one or more cylinders.

Referring to FIGS. 1, 2, and 6, the present invention pertains to a device for controlling the movement of a valve 15, which allows intake or exhaust flow of a combustion chamber through runner 15*a*, with a double acting actuator piston 11. A series of flow control devices, including solenoid actuated spools 20 & 21 used to communicate fluid to the upper chamber 13 and check valves 22 & 23 (or as an alternate embodiment, solenoid actuated spools) used to communicate compressible fluid to the lower chamber 14, coordinated so as to operate the valve 15 through chamber-pressure differential. In the primary embodiment both chambers 13 & 14 receive pressure regulated compressed air.

The double acting actuator piston 11 is displaceably arranged within an actuator cylinder 12 so as to separate chambers 13 & 14, and is manufactured such that leakage between the opposing chambers 13 &14 can be controlled (sealed) while allowing the necessary movement to double-actuate (open and close) the valve 15. The actuator piston 11 is mechanically attached to the valve 15 stem so as to move the valve 15 within the valve 15 guide.

In construction, the actuator cylinder 12 and chambers 13 & 14 are formed in a housing that may be a cast-in-place part of the engine head or mechanically fastened in place. The housing has an inlet 16 and an outlet 17 for the upper chamber 13 and an inlet 18 and an outlet 19 for the lower chamber 14 either as part of the housing, within end-cap 10, or a combination. In addition, the housing and/or end cap(s) may provide for mounting pressure and/or flow control devices as described below, and connecting supply 20*b* and 22*b*, and exhaust 21*b* and 23*b* manifolds.

The upper chamber inlet 16 pressure control consists of two spools 20, which function as an 'XNOR gate', actuated independently by electronically controlled solenoids 20*a*. The upper chamber inlet pressure is supplied from a pressure regulated supply manifold 20*b* in the preferred embodiment.

The upper chamber outlet 17 pressure relief consists of a single spool 21 moved by an electronically actuated solenoid 21*a*. Alternately, the upper chamber outlet 17 pressure relief can be two spools, which function as an 'XNOR gate', actuated independently by bistable electronically controlled solenoids. The upper chamber outlet pressure is exhausted to a pressure regulated exhaust manifold 21*b* in the preferred embodiment.

The lower chamber inlet 18 pressure control consists of a check valve 22, connected to the pressure regulated supply manifold 22*b*. Alternately, the lower chamber inlet 18 pressure control can be a single spool actuated by an electronically controlled solenoid (not shown).

The lower chamber outlet 19 pressure relief consists of a check valve 23, connected to the pressure regulated exhaust manifold 23*b*, to the atmosphere, or to other suitable outlet. Alternately, the lower chamber outlet 19 pressure relief can be a single spool actuated by an electronically controlled solenoid.

As shown in FIG. 6, the expected use of the present invention is a coordinated system of more than one actuator device, each actuator device mechanically connected to an intake valve 15 or an exhaust valve 15 of an internal combustion engine, one device per valve 15. Alternately, it is possible to actuate more than one valve 15 for each actuator through the use of lever arms or other mechanical connections.

The bistable solenoids 20*a* and (if used) 21*a* are triggered by an electronic control circuit consisting of a microprocessor, various inputs and sensors, shift registers (optional for small systems), H-bridge controller circuits or ICs and the connectors, power supplies, switches, relays, and the necessary circuitry and parts to connect, regulate, and protect these components. To implement the interactive features of a programmable system, additional interface connections (OBDII, USB, or equivalent, or wireless) are required, as is a program to allow programming, configuring, and I/O with, the microprocessor.

Figure 3:
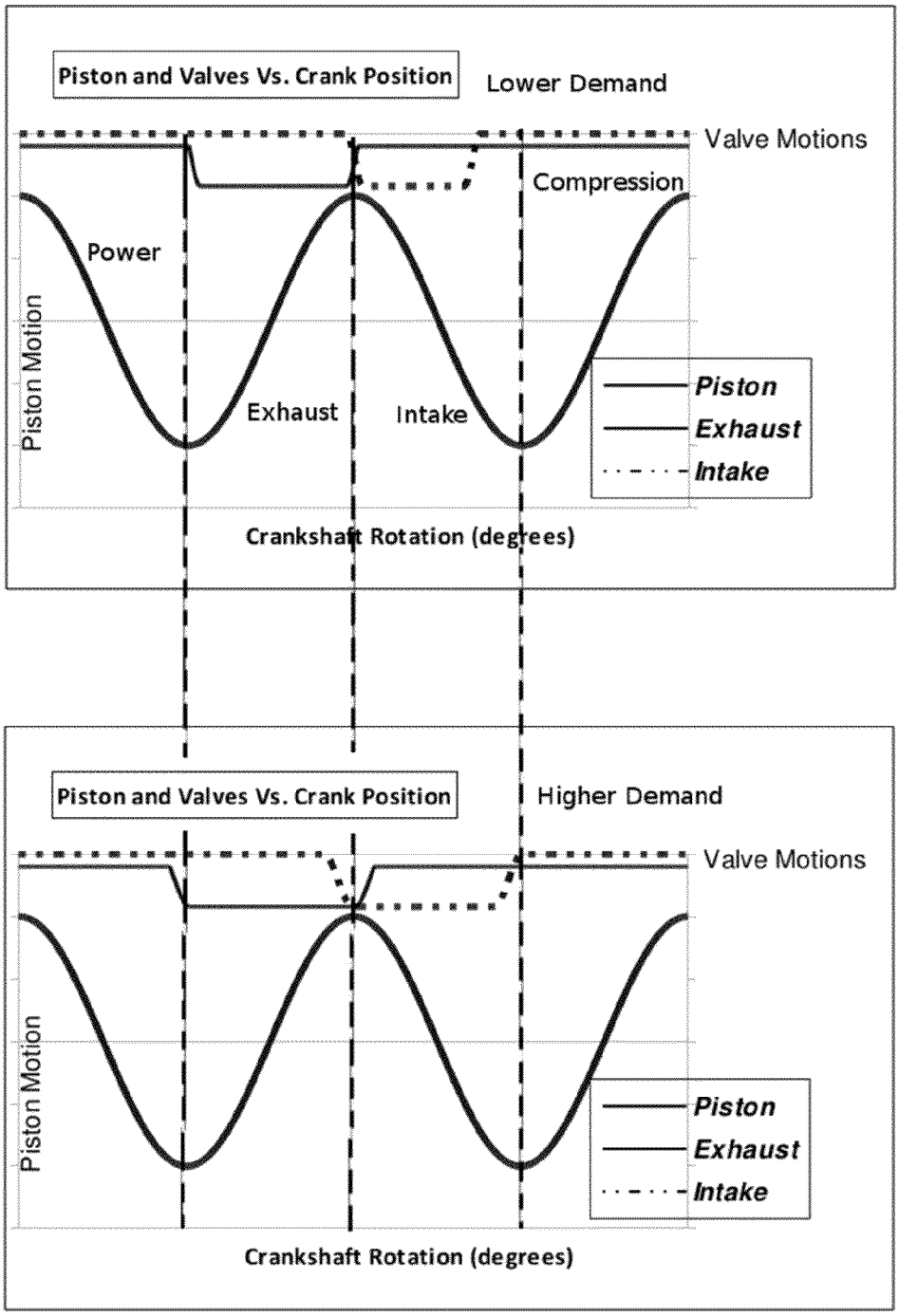
FIG. 3 shows double vertical axis Cartesian diagrams as a function of piston position of one version of the curves of the lift of an intake and exhaust valve associated with a valve actuating device of the present invention under two different hypothetical operating conditions.

Referring to FIGS. 3 and 4, in the primary embodiment each pressure regulator and solenoid is controlled electronically so that the timing and extent of valve 15 movement is adjustable to meet engine operating parameters by a combination of pressure settings and timing signals. Varying the pressure in the supply 20*b* and exhaust 21*b* manifolds and of the operating pressure of one-way check valves 22 and 23 (by the pressure settings of manifold 22*b* and 23*b*) enables the valve 15 to be subjected to (relatively) lower forces at low rpm and only subjected to higher forces at high rpm.

Referring to FIGS. 5A and 5B, the method of controlling valve 15 movement relies on the cycle of pressures applied to the actuator piston 11 by differential chamber pressure, sample calculations used to develop these pressure settings and forces resulting therefrom are shown. The upper chamber high pressure provides valve 15 opening force, net of lower chamber low-through-high pressure (transitioning as the fluid is compressed) and then hold open force. The lower chamber high pressure provides valve 15 return force, net of upper chamber low pressure (once upper chamber high pressure is released). The lower chamber low pressure provides valve seat force, net of upper chamber low pressure. In summary, the lower chamber acts as a pneumatic spring, while varying pressure in the upper chamber alternately compresses and releases this pneumatic spring.

More specifically, the upper chamber inlet spools 20 can be controlled as an 'XNOR gate' to independently and variably control valve 15 timing, duration and lift, using the following preferred method: Valve 15 timing and duration are controlled by the timing of the triggering of the inlet solenoid (pair) 20*a* and outlet solenoid 21*a*, particularly alternating states of the inlet spools 20, actuating common ports to allow fluid flow and pressure communication, and actuation of non-common ports to block pressure communication and fluid flow, from manifold 20*b* into the upper chamber 13, only movement of one spool at a time being required to effect a state change. Signal processing and inertial movement delays within the system—typically on the order of a few milliseconds, as well as engine crankshaft angle and rotational speed, are used to calculate solenoid 20*a* and 21*a* control trigger signal generation. Discrete signals to the pair of inlet solenoids control charge-pulse duration (therefore volume and pressure) and offset signal timing can control valve 15 lift. For required charge-pulse durations equal to or longer than solenoid movement duration (on the order of 5 ms), one solenoid (e.g. currently at logic state 'A') is triggered with or prior to the other solenoid (e.g. currently at logic state 'B'). For shorter required charge-pulse durations (and lower valve 15 lift), the second solenoid above is triggered slightly prior to the first solenoid above, thus allowing shortening of the charge-pulse duration to as short as the signal switching repeatability limits (on the order of 0.5 ms). In the preferred embodiment the upper chamber outlet spool 21 can be accurately controlled by a single solenoid since the outlet 17 discharge-pulse duration is not as critical as the inlet 16 charge-pulse duration and the outlet pressure is suitably controlled by the exhaust manifold 21*b*, valve 15 closure 'lift' being constant 0.

The adjustment to the lower chamber low pressure is through a one-way check valve 22, in which supply pressure can pass through the one-way check valve 22 when the lower chamber low pressure falls below a determined level. The adjustment to the lower chamber high pressure is through a one-way check valve 23 when the lower chamber high pressure exceeds a determined level. The preferred embodiment is for the one-way check valves 22 & 23 to be attached to pressure adjustable manifolds 22*b* and 23*b* respectively, thereby allowing dynamic adjustment during engine operation.

The timing of valve 15 operation can be altered to enable smooth low rpm operation (later intake pulse and decreased valve overlap) and efficient high rpm operation (earlier intake pulse and increased valve overlap) with an almost continuous transition. The duration and lift of valve 15 operation can be altered to meet low demand (short duration, small lift) and high demand (long duration, large lift) with an almost continuous transition. In addition, unique combinations are available with this system: some valves 15 (and thereby, combined with temporary fuel and possibly ignition spark cutout, some combustion chambers) can be temporarily non-actuated, allowing the engine to behave as one of smaller displacement operating at increased air-flow (higher efficiency during low demand operation); some valves 15 timing can be staggered within an engine cylinder to promote fuel-air swirl; some valves 15 can be actuated or non-actuated to allow engine cylinders to behave as two or more valve 15 arrangements to meet varying operating parameters. To influence vibration and temperature variation between cylinders when such non-actuation is in practice, the firing order may be adjusted while the engine is in operation, for instance by switching (a) pair(s) of cylinders separated by 360 degrees (½ of an engine cycle). An increase in efficiency is expected due to removal of the throttle plate, varying valve duration and lift, and cylinder cut-out, to control fuel-air induction, thereby reducing pumping losses through the engine.

An orifice restricted upper chamber outlet muffler (not shown) may be incorporated to provide a 'soft seat' for valve 15 closure. Mechanical methods of softening the impact (so called 'bump stops') at piston 11 travel limits may be used as well. Although the primary embodiment uses both of these braking methods to reduce noise and mechanical wear, some (or all) applications may function normally without this 'braking' or may use a substitute method.

Referring to FIGS. 3, 4, 5A and 5B, a unique benefit of the primary embodiment is the flexibility for maintenance and upgrade programming of the electronic control system. This method will allow manufacturers and tuners to tailor engines for different operating conditions and demands and update in-place systems as changes are specified without changing hardware in many instances. A layered software system design is preferred wherein a main program determines overall behavior characteristics of the system and a parameter table is used to 'tune' the system. Different 'modes' can be pre-programmed to allow the driver to select from a set of engine performance behaviors (ex: 'economy', 'city', 'sport', 'towing', 'valet', etc.).

The preferred embodiment uses a continuously replenished pneumatic (air) supply and exhaust system for speed of operation and low cost construction. One alternate embodiment could use hydraulic fluid as the upper chamber 13 circuit fluid, although this would require changes to the seals and pressure system, and the use of a recovery and storage system.

A limitation of the present invention is leak-down over time. Although some leak-down is unavoidable and easily dealt with, a seal failure or engine start after a long delay could lead to engine damage due to piston-valve interference. There are two strategies for dealing with this potential: Primarily, the device can be restricted to use in non-interference engines. The decrease in power and efficiency can be more than recouped by turbo-charging the engine intake system. Since this is common and inherently increases efficiency it is the preferred embodiment. Secondly, the system can incorporate safety pumps and latches to prevent piston-valve strike under normal operation, including startup. For system reliability it is anticipated that some form of monitoring system, most likely one or more pressure sensors, will be incorporated into the electronic and/or fluid circuits. For non-interference engines, a maintenance mode may be programmed that when selected will allow the valves to operate as if the crankshaft was turning in order to check for proper operation.

The present invention may provide all or some of the benefits described above, depending on the specifications (both mechanical and electronic) as implemented. Not all of the benefits will be realized for all applications and failure to provide a desired benefit in any particular application or combination of applications should not be interpreted to limit the scope of the claims made.

Although the present invention has been described in considerable detail with reference to certain preferred versions thereof, it is understood that other alternates and equivalents of each of the above embodiments are within the scope of the invention. Therefore, the spirit and scope of the appended claims should not be limited to the description of the preferred versions contained therein. Accordingly, all such modifications are intended to be included within the scope of the invention as defined in the following claims. In the claims, means-plus-function clauses are intended to cover the structures described herein as performing the recited function and not only structural equivalents, but also equivalent structures.

The invention claimed is:

1. A device for controlling the movement of an intake or exhaust valve of an internal combustion engine combustion chamber, the control device comprising:

a double acting actuator piston, displaceably arranged within a pressurizable cylinder so as to form upper and lower chambers of inversely variable volume, mechanically affixed to a valve stem so as to influence the position and movement of the valve via chamber-pressure differential, and a programmable, fluid circuit for controlling the timing of, force on, or lift of the valve via the upper and lower chambers, the upper chamber being located relatively farther away from the engine's combustion chamber;

the fluid circuit comprises first, second, third, and fourth independently and selectively controllable pressurized fluid sources, each of said fluid sources being operatively connected to only one of the upper chamber inlet, upper chamber outlet, lower chamber inlet, and lower chamber outlet.

* * * * *